US011799249B2

(12) United States Patent
Kojima et al.

(10) Patent No.: US 11,799,249 B2
(45) Date of Patent: Oct. 24, 2023

(54) ELECTRIC CONNECTOR WITH OUTER CONDUCTOR CONNECTED TO CIRCUIT BOARD

(71) Applicant: SUMITOMO WIRING SYSTEMS, LTD., Mie (JP)

(72) Inventors: Yusuke Kojima, Mie (JP); Yuki Kondo, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/405,358

(22) Filed: Aug. 18, 2021

(65) Prior Publication Data

US 2022/0059975 A1 Feb. 24, 2022

(30) Foreign Application Priority Data

Aug. 20, 2020 (JP) ..... 2020-139325

(51) Int. Cl.

| | |
|---|---|
| ***H01R 13/6594*** | (2011.01) |
| ***H01R 12/72*** | (2011.01) |
| *H01R 103/00* | (2006.01) |
| *H01R 13/648* | (2006.01) |
| *H01R 13/40* | (2006.01) |
| *H01R 13/658* | (2011.01) |
| *H01R 13/6591* | (2011.01) |
| *H01R 24/50* | (2011.01) |

(52) U.S. Cl.

CPC ..... *H01R 13/6594* (2013.01); *H01R 12/724* (2013.01); *H01R 13/40* (2013.01); *H01R 13/648* (2013.01); *H01R 13/658* (2013.01); *H01R 13/6591* (2013.01); *H01R 24/50* (2013.01); *H01R 2103/00* (2013.01)

(58) Field of Classification Search

CPC .. H01R 13/6594; H01R 12/724; H01R 13/40; H01R 13/648; H01R 13/658; H01R 13/6591; H01R 24/50; H01R 2103/00

See application file for complete search history.

(56) References Cited

U.S. PATENT DOCUMENTS

| | | | | |
|---|---|---|---|---|
| 10,566,741 | B2 | 2/2020 | Maesoba et al. | |
| 2019/0207347 | A1* | 7/2019 | Maesoba | H01R 13/6594 |

FOREIGN PATENT DOCUMENTS

| | | | | |
|---|---|---|---|---|
| CN | 1232303 | A * | 10/1999 | H01R 13/432 |
| JP | 2005-038725 | A | 2/2005 | |
| JP | 2017-045604 | A | 3/2017 | |

* cited by examiner

*Primary Examiner* — Abdullah A Riyami
*Assistant Examiner* — Justin M Kratt
(74) *Attorney, Agent, or Firm* — Venjuris, P.C.

(57) ABSTRACT

A connector includes inner conductors and an outer conductor. The outer conductor includes four plate portions surrounding outer peripheral surfaces of the inner conductors, a rear plate portion for closing a rear surface of the outer conductor and an opening provided behind the bottom plate portion and in front of the rear plate portion. The inner conductor includes a board connecting portion projecting outwardly of the outer conductor through the opening. The outer conductor includes a common base end portion connected to a rear end of the bottom plate portion via a bent portion and projecting toward the same side as the board connecting portion, and a plurality of branched pieces projecting from a projecting end of the common base end portion while being arranged in a width direction of the common base end portion.

7 Claims, 7 Drawing Sheets

ELECTRIC CONNECTOR WITH OUTER CONDUCTOR CONNECTED TO CIRCUIT BOARD

CROSS-REFERENCE TO RELATED APPLICATIONS

This application is based on and claims priority from Japanese Patent Application No. 2020-139325, filed on Aug. 20, 2020, with the Japan Patent Office, the disclosure of which is incorporated herein in their entireties by reference.

TECHNICAL FIELD

The present disclosure relates to a connector.

BACKGROUND

Japanese Patent Laid-open Publication No. 2017-045604 discloses a shield connector with a contact (inner conductor) and an inner shell (outer conductor). The inner shell includes an inner shell body in the form of a rectangular tube, and an opening for causing the contact to project is formed on a rear side of a bottom plate portion constituting the inner shell body. The inner shell body includes a board connecting portion extending downward from the front end of the opening. A connector with an inner conductor and an outer conductor is also disclosed in Japanese Patent Laid-open Publication Nos. 2005-038725 and 2018-006152.

SUMMARY

In the connector of Japanese Patent Laid-open Publication No. 2017-045604, the board connecting portion is formed to be wide. A long hole into which this board connecting portion is inserted is formed on a board side. However, it is not preferable in terms of easily forming a hole to form the long hole having a large opening width corresponding to the width of the board connecting portion in the board. On the other hand, if the board connecting portion is narrowed, the formation of the long hole can be avoided, but it is not preferable since shielding performance is reduced.

Accordingly, the present disclosure aims to ensure the shielding performance of a connector.

The present disclosure is directed to a connector with an outer conductor and an inner conductor, wherein the outer conductor includes four plate portions for surrounding an outer peripheral surface of the inner conductor, a rear plate portion for closing a rear surface of the outer conductor, and an opening provided behind one plate portion, out of the four plate portions, and in front of the rear plate portion, the inner conductor includes a board connecting portion projecting outwardly of the outer conductor through the opening, and the outer conductor includes a common base end portion connected to a rear end of the one plate portion via a bent portion and projecting toward the same side as the board connecting portion, and a plurality of branched pieces projecting from a projecting end of the common base end portion while being arranged in a width direction.

According to the present disclosure, it is possible to ensure the shielding performance of a connector.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
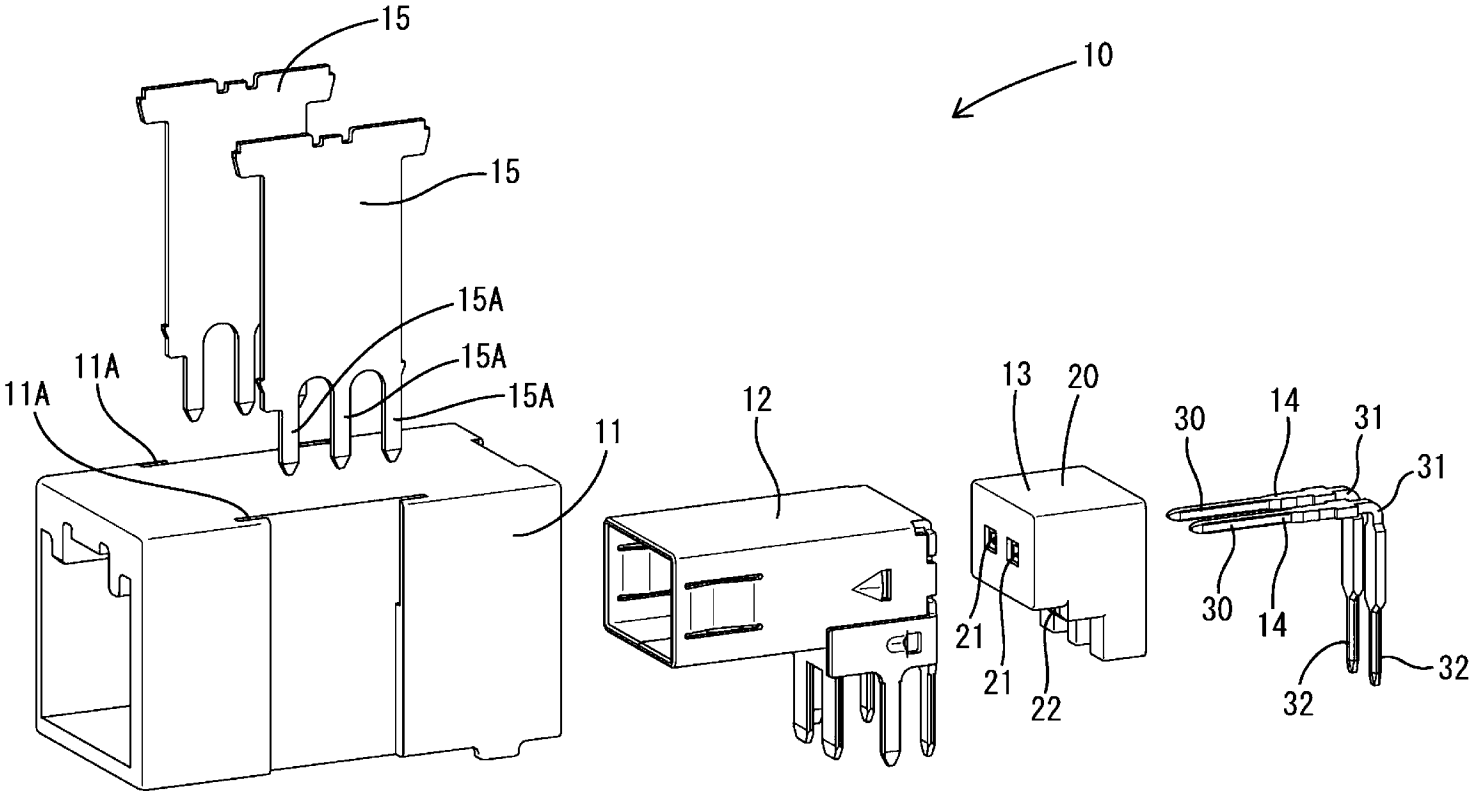
FIG. 1 is an exploded perspective view of a connector of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The connector of the present disclosure includes an outer conductor and an inner conductor, wherein the outer conductor includes four plate portions for surrounding an outer peripheral surface of the inner conductor, a rear plate portion for closing a rear surface of the outer conductor, and an opening provided behind one plate portion, out of the four plate portions, and in front of the rear plate portion, the inner conductor includes a board connecting portion projecting outwardly of the outer conductor through the opening, and the outer conductor includes a common base end portion connected to a rear end of the one plate portion via a bent portion and projecting toward the same side as the board connecting portion, and a plurality of branched pieces projecting from a projecting end of the common base end portion while being arranged in a width direction of the common base end portion.

Since this connector includes the plurality of branched pieces, shielding performance can be ensured. Further, if connection partners of the respective branched pieces are a circuit board, individual holes into which the respective branched pieces are inserted can have a small opening width in the circuit board. Further, this connector includes the common base end portion connected to the rear end of the one plate portion via the bent portion and the plurality of branched pieces project from the projecting end of this common base end portion while being arranged in the width direction. Thus, in this connector, the respective branched pieces can be turned in direction at once, for example, in forming the bent portion by bending. Therefore, according to this connector, manufacturing is easy and the orientations of the respective branched pieces are easily aligned.

(2) Preferably, the one plate portion includes a first plate portion arranged on one side in the width direction and a second plate portion arranged on the other side in the width direction, the respective first and second plate portions include facing end parts arranged to face each other, the facing end part includes a first facing end part extending forward from a rear end of the one plate portion, a second facing end part extending rearward from a front end of the one plate portion and a third facing end part linking a front end of the first facing end part and a rear end of the second facing end part, the first facing end part is arranged at a position shifted from a central part in the width direction where the bent portion is provided in the one plate portion, and the second facing end part is arranged at a position closer to a center in the width direction than the first facing end part in the one plate portion.

The first facing end part of this connector is arranged at the position shifted from the widthwise central part where the bent portion is provided. Thus, the bent portion provided in the widthwise central part is not divided in the width direction. Further, the second facing end part of this connector is arranged at the position closer to the center in the width direction than the first facing end part. Thus, the first and second plate portions are, for example, easily formed by bending.

Preferably, a width of the bent portion is smaller than that of the common base end portion.

Since the width of the bent portion is smaller than that of the common base end portion according to this connector, the bent portion is easily bent and a bending angle of the bent portion is easily adjusted.

Details of Embodiment of Present Disclosure

A specific example of the present disclosure is described below with reference to the drawings. Note that the present invention is not limited to these illustrations and is intended to be represented by claims and include all changes in the scope of claims and in the meaning and scope of equivalents.

Embodiment

A connector 10 to be mounted on a surface of a circuit board 90 (see FIG. 7) is illustrated in one embodiment. As shown in FIG. 1, the connector 10 includes a housing 11, an outer conductor 12, a dielectric 13, a plurality of (two in this embodiment) inner conductors 14 and a plurality of (two in this embodiment) fixing members 15. The outer peripheral surfaces of the inner conductors 14 are surrounded by four plate portions of the outer conductor 12 with the inner conductors 14 assembled with the dielectric 13. The outer conductor 12 is accommodated into the housing 11 in the form of a rectangular tube. The housing 11 is fixed to the surface of the circuit board 90 by the fixing members 15.

Figure 3:
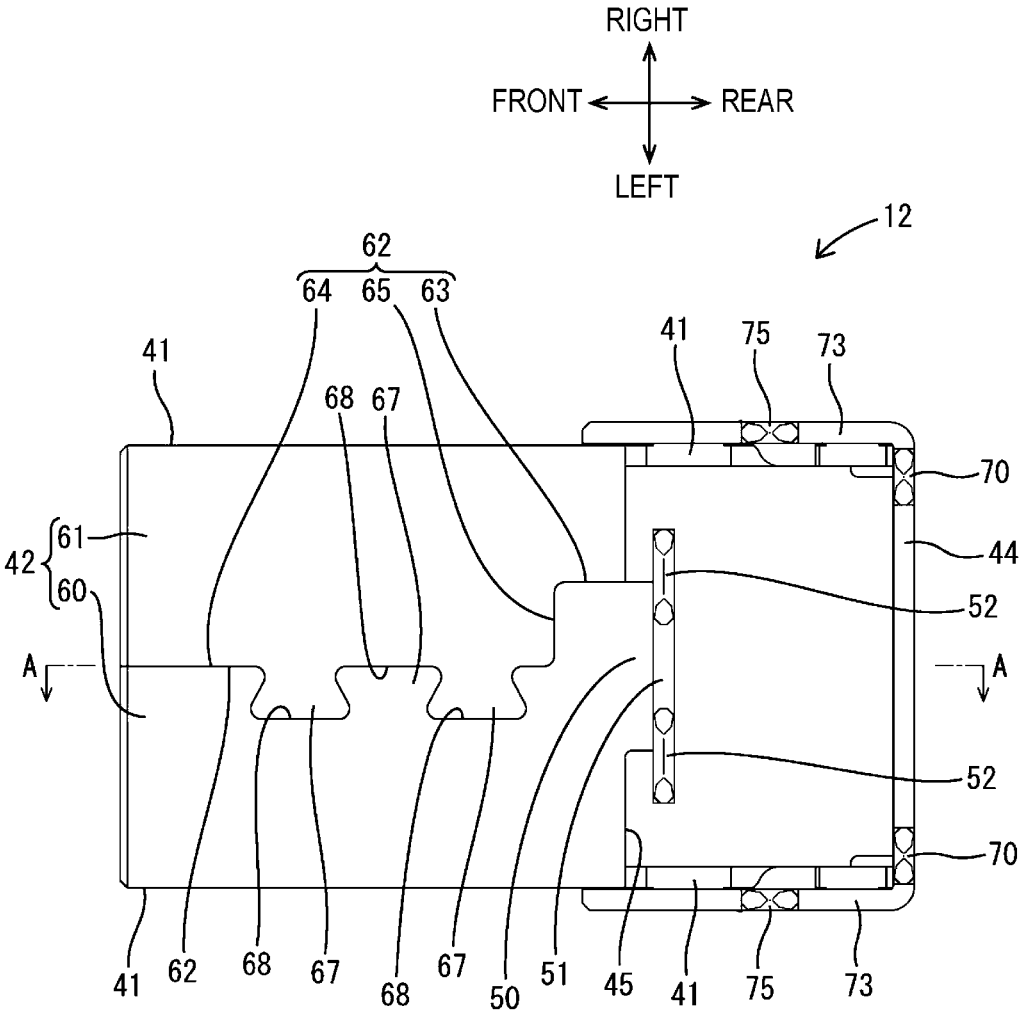
FIG. 3 is a bottom view of the outer conductor.
Figure 4:
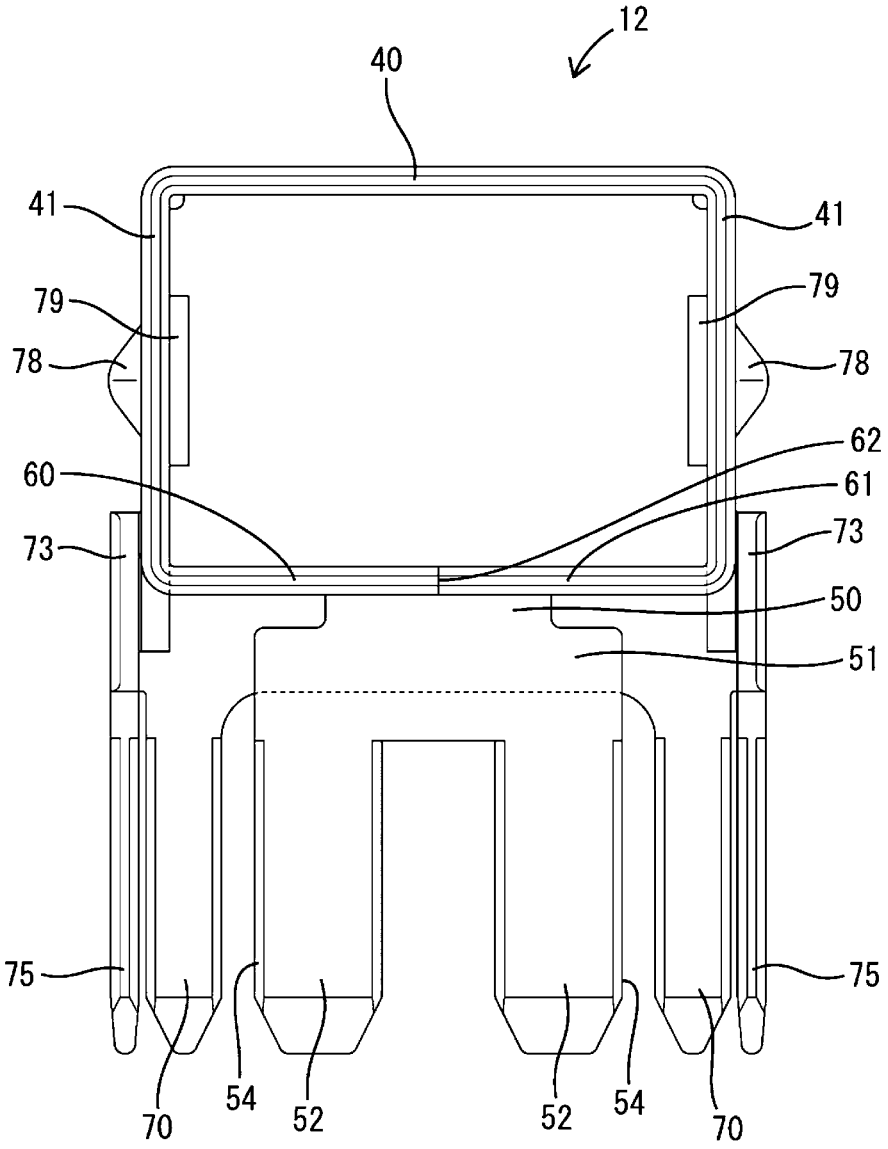
FIG. 4 is a front view of the outer conductor.
Figure 5:
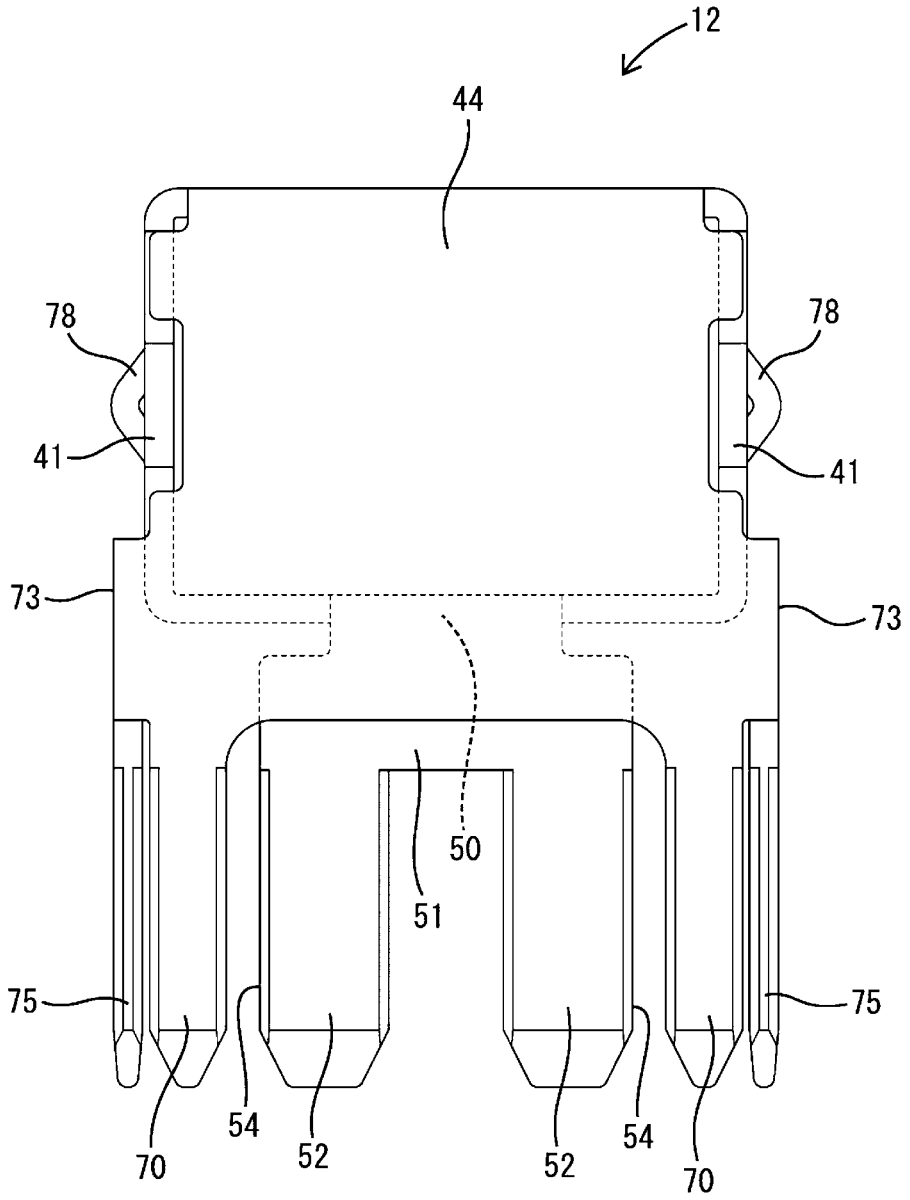
FIG. 5 is a back view of the outer conductor.
Figure 6:
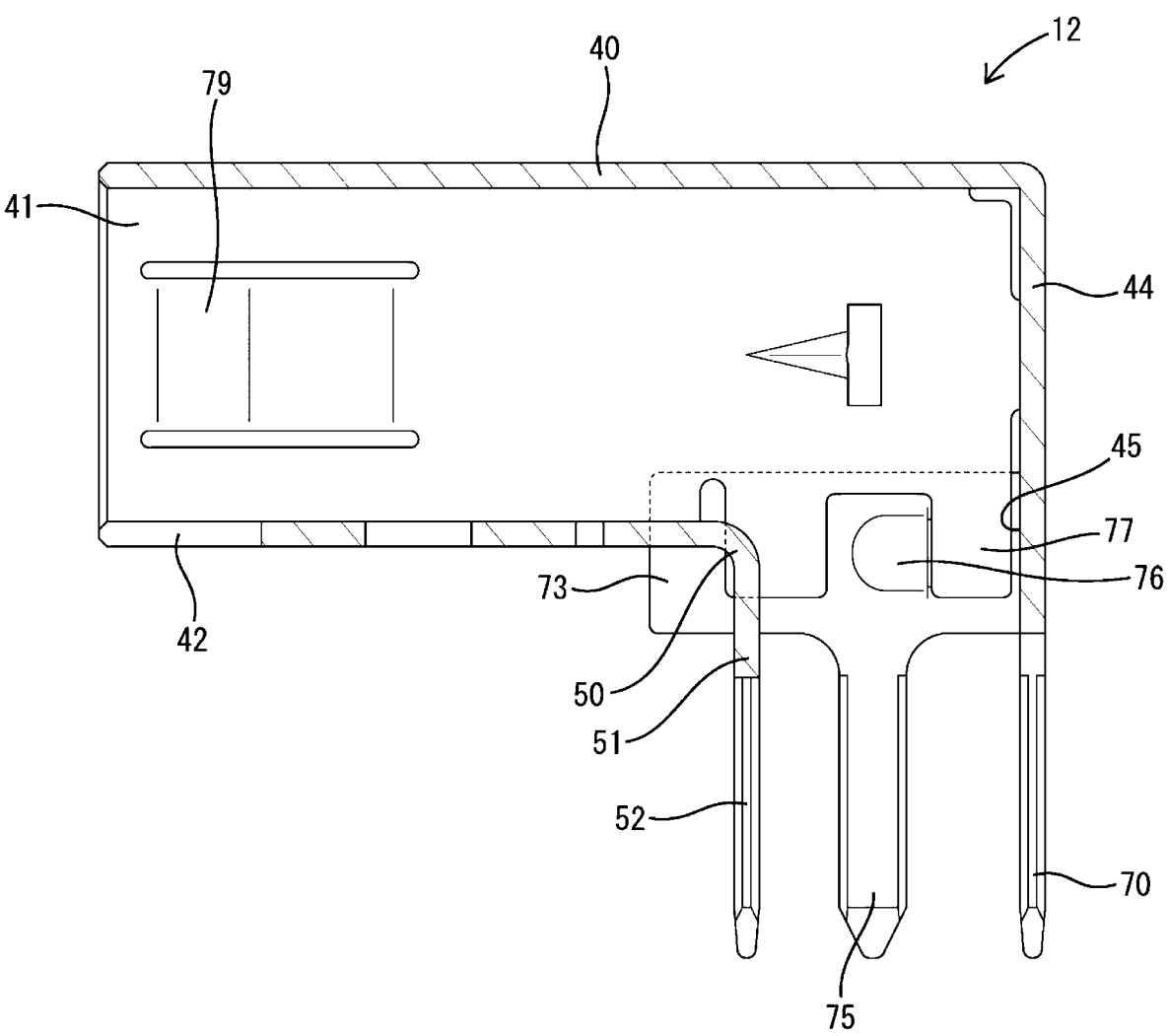
FIG. 6 is a section along A-A of FIG. 3.
Figure 7:
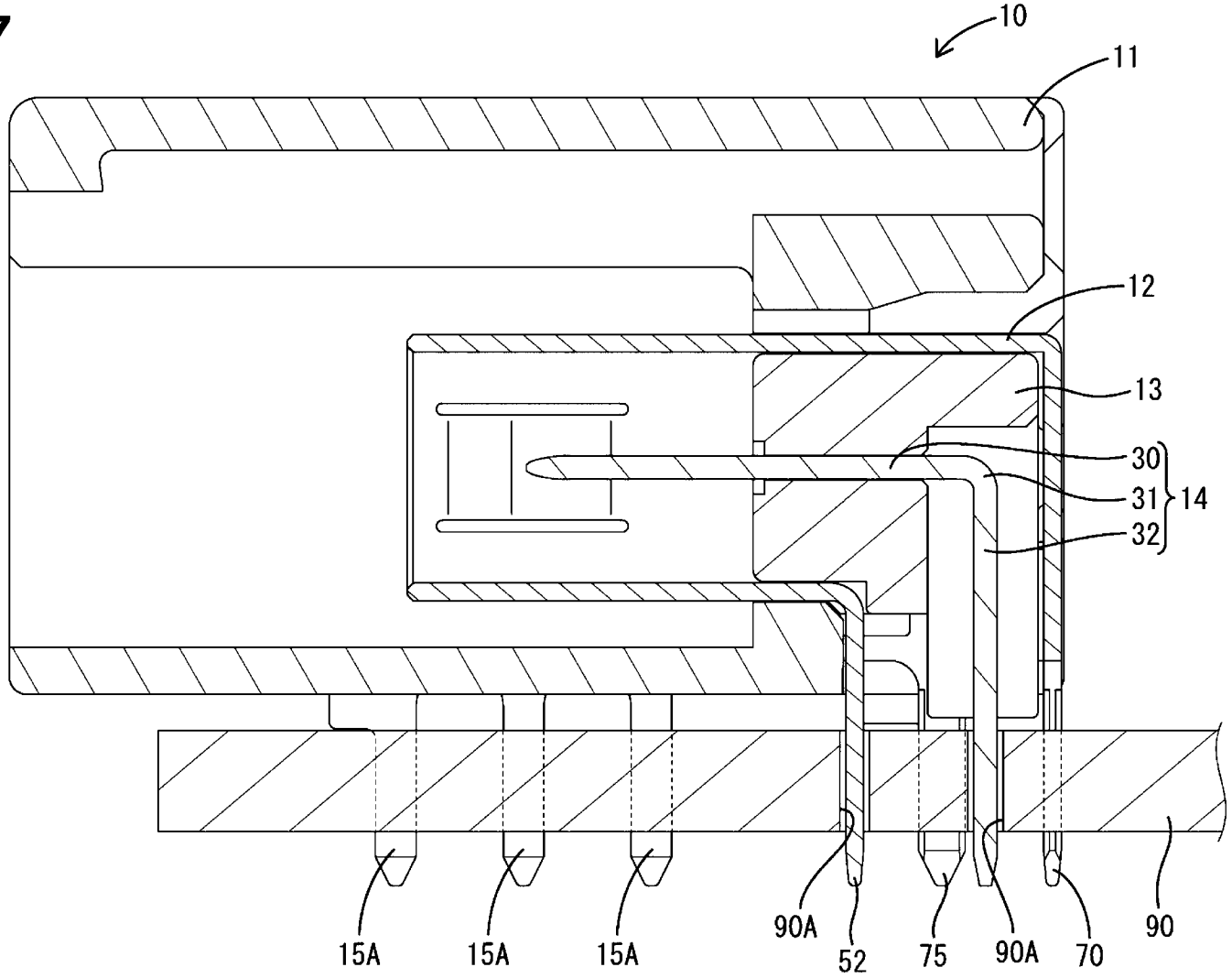
FIG. 7 is a side view in section of the connector.

Note that, in the following description, upper and lower sides shown in FIGS. 4 to 7 are directly defined as upper and lower sides concerning a vertical direction. Left and right sides shown in FIGS. 3, 6 and 7 are referred to as front and rear sides concerning a front-rear direction. Concerning a lateral direction, lower and upper sides shown in FIG. 3 are referred to as left and right sides, left and right sides shown in FIG. 4 are directly defined as left and right sides, and right and left sides shown in FIG. 5 are referred to as left and right sides. That is, an extending direction of the four plate portions in the outer conductor 12 is the front-rear direction, a side to be connected to a mating connector is a front side, and a side opposite to the front side is a rear side. Further, a side to be connected to the circuit board 90 is a lower side, and a side opposite to the lower side is an upper side. Further, a direction intersecting (e.g. orthogonal to) the front-rear direction and the vertical direction is the lateral direction.

The housing 11 is made of synthetic resin and, as shown in FIGS. 1 and 7, open forward and, in a rear end part, open rearward and downward. Fixing member mounting portions 11A are formed on both left and right sides of the housing 11, and the fixing members 15 are mounted thereinto. The fixing member 15 includes a plurality of (three in this embodiment) projection pieces 15A projecting downward. The housing 11 is fixed to the circuit board 90 by fixing the projection pieces 15A of the fixing members 15 to the circuit board 90.

The dielectric 13 is made of synthetic resin. As shown in FIGS. 1 and 7, the dielectric 13 includes a block-like dielectric body 20, a plurality of (two in this embodiment) mounting holes 21 and a restricting portion 22. The mounting holes 21 are holes into which the inner conductors 14 are mounted, and penetrate through the dielectric body 20 in the front-rear direction. The restricting portion 22 is formed in a step-like manner on the lower surface of the dielectric body 20, and restricts a forward movement of the dielectric 13 by butting against the rear surface of the outer conductor 12 (more specifically, a bottom plate portion 42 to be described later).

As shown in FIGS. 1 and 7, the inner conductor 14 is narrow and long and L-shaped. The inner conductor 14 includes a terminal connecting portion 30, a terminal bending portion 31 and a board connecting portion 32. The terminal connecting portion 30 is a part to be connected to a mating terminal fitting, and extends in the front-rear direction with the inner conductor 14 mounted in the outer conductor 12 via the dielectric 13. The board connecting portion 32 is a part to be connected to the circuit board 90, is connected to a rear end part of the terminal connecting portion 30 via the terminal bending portion 31 and extends downward in the mounted state. The inner conductor 14 is mounted into the dielectric 13 by inserting the terminal connecting portion 30 into the mounting hole 21 of the dielectric 13 from behind. More specifically, the inner conductor 14 is press-fit into the mounting hole 21 of the dielectric 13.

Figure 2:
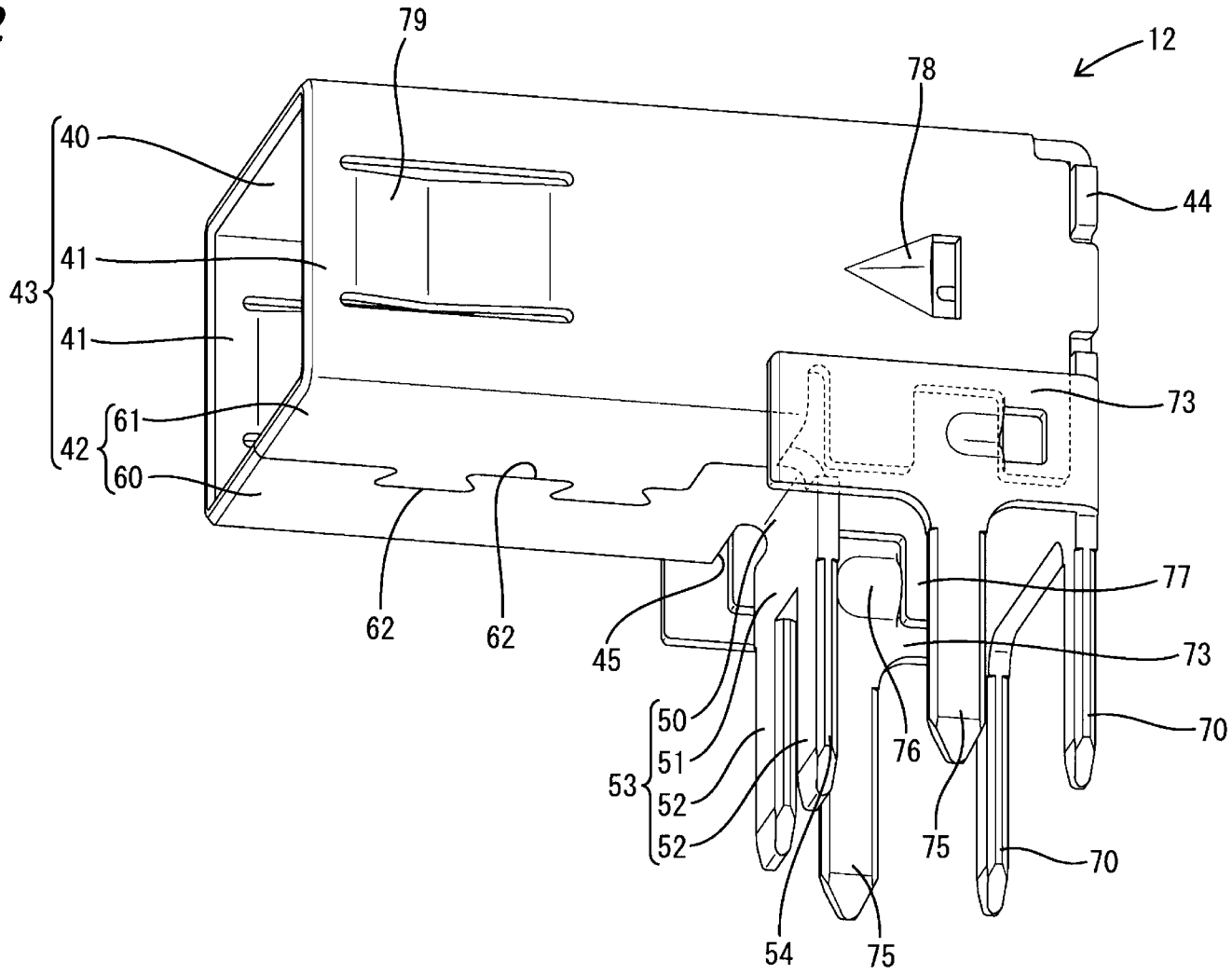
FIG. 2 is a perspective view of an outer conductor.

The outer conductor 12 is formed by applying bending and the like to a conductive metal plate material. As shown in FIG. 2, the outer conductor 12 includes a ceiling plate portion 40, a pair of first side plate portions 41 and the bottom plate portion 42 as the four plate portions. The ceiling plate portion 40, the pair of first side plate portions 41 and the bottom plate portion 42 constitute a rectangular tube portion 43 open in the front-rear direction. The pair of first side plate portions 41 are connected to both left and right ends of the ceiling plate portion 40 and extend downward. Both left and right ends of the bottom plate portion 42 are connected to lower ends of the pair of first side plate portions 41. Note that the bottom plate portion 42 is equivalent to an example of one plate portion.

As shown in FIGS. 2 to 5, the outer conductor 12 includes a rear plate portion 44 and an opening 45. The rear plate portion 44 closes the rear surface of the rectangular tube portion 43. The rear plate portion 44 is connected to a rear end part of the ceiling plate portion 40 and extends downward. The rear end of the bottom plate portion 42 is arranged forwardly of the front surface of the rear plate portion 44. The opening 45 is provided behind the bottom plate portion 42 and in front of the rear plate portion 44. That is, the opening 45 is formed by being surrounded by the pair of first side plate portions 41, the bottom plate portion 42 and the rear plate portion 44. The opening 45 communicates with the inside of the rectangular tube portion 43 and is open downward. The board connecting portion 32 of the inner conductor 14 described above projects to the outside of the outer conductor 12 (downward in this embodiment) through the opening 45 in a mounted state (see FIG. 7).

The outer conductor 12 includes a bent portion 50, a common base end portion 51, and a plurality of branched pieces 52. The bent portion 50, the common base end portion 51 and the plurality of branched pieces 52 constitute a first connection piece 53. The first connection piece 53 is connected to the rear end of the bottom plate portion 42 and is bent at the bent portion 50, and the common base end portion 51 and the branched pieces 52 project downward. The first connection piece 53 is arranged inside the opening 45. A width direction of the first connection piece 53 (more specifically, the bent portion 50, the common base end portion 51 and the branched pieces 52) is the lateral direction.

The bent portion 50 is connected to the rear end of the bottom plate portion 42 and formed to be long in the lateral direction. A width of the bent portion 50 is smaller than the width in the lateral direction of the bottom plate portion 42. The bent portion 50 is arranged in a widthwise central part of the bottom plate portion 42.

The common base end portion 51 is connected to the rear end of the bottom plate portion 42 via the bent portion 50 and extends downward. The common base end portion 51 is shaped to protrude in the width direction from the lower end of the bent portion 50. The common base end portion 51 has a rectangular shape long in the lateral direction in a front view. A width of the common base end portion 51 is smaller than that of the bottom plate portion 42 and larger than that of the bent portion 50. The upper end of the common base end portion 51 is arranged below the lower surface of the bottom plate portion 42.

The plurality of branched pieces 52 project downward from the lower end of the common base end portion 51 while being arranged in the width direction of the common base end portion 51. The plurality of branched pieces 52 are arranged while being spaced apart from each other in the width direction. The branched pieces 52 are arranged on both widthwise ends of the common base end portion 51. The branched pieces 52 have continuous surfaces 54 continuous from both widthwise side surfaces of the common base end portion 51 without any step. The widthwise inner surfaces of the branched pieces 52 are orthogonal to the lower surface of the common base end portion 51. Both widthwise end parts and tip parts of the branched pieces 52 are chamfered.

As shown in FIG. 3, the bottom plate portion 42 includes a first plate portion 60 and a second plate portion 61. The first plate portion 60 is arranged on a left side, and the second plate portion 61 is arranged on a right side. The left end of the first plate portion 60 is connected to the lower end of the left first side plate portion 41 and the first plate portion 60 extends rightward. The right end of the second plate portion 61 is connected to the lower end of the right first side plate portion 41 and the second plate portion 61 extends leftward.

The respective first and second plate portions 60, 61 include facing end parts 62 arranged to face each other. The facing end part 62 includes a first facing end part 63, a second facing end part 64 and a third facing end part 65.

The first facing end part 63 extends forward from the rear end of the bottom plate portion 42. The second facing end part 64 extends rearward from the front end of the bottom plate portion 42. The third facing end part 65 extends in the width direction of the bottom plate portion 42 and links the front end of the first facing end part 63 and the rear end of the second facing end part 64. The first facing end part 63 is arranged at a position shifted rightward from a widthwise central part of the bottom plate portion 42, and arranged on an extension along the right end surface of the bent portion 50. A length of the first facing end part 63 is shorter than that of the second facing end part 64.

The facing end parts 62 include fitting portions 67 and fitting grooves 68 to be fit to each other. The fitting portion 67 of the first plate portion 60 projects toward the second plate portion 61, and the tip thereof is widened in the front-rear direction. The fitting portions 67 of the second plate portion 61 project toward the first plate portion 60, and the tips thereof are widened in the front-rear direction. The fitting portions 67 of the second plate portion 61 are fit into the fitting grooves 68 of the first plate portion 60. The fitting portion 67 of the first plate portion 60 is fit into the fitting groove 68 of the second plate portion 61. The fitting portions 67 and the fitting grooves 68 are arranged in the second facing end parts 64, but not arranged in the first and third facing end parts 63, 65.

As shown in FIGS. 4 and 5, the outer conductor 12 includes a pair of second connection pieces 70. The second connection pieces 70 project downward from the lower end of the rear plate portion 44. That is, the second connection pieces 70 are arranged on a rear side of the opening 45. Further, the second connection pieces 70 are arranged rearwardly of the respective branched pieces 52. The lower end of the rear plate portion 44 is arranged below the lower surface of the bottom plate portion 42, and arranged above the lower end of the common base end portion 51. A width direction of the connection pieces 70 is the lateral direction. The second connection pieces 70 are arranged outwardly of both left and right ends of the common base end portion 51 and arranged outwardly of the pair of branched pieces 52 in the width direction. Widths of the second connection pieces 70 are smaller than those of the branched pieces 52. Widthwise outer side surfaces of the second connection pieces 70 are orthogonal to the lower surface of the rear plate portion 44. Widthwise inner side surfaces of the second connection pieces 70 are connected to the lower surface of the rear plate portion 44 via curved surfaces. Both widthwise end parts and tip parts of the second connection pieces 70 are chamfered.

As shown in FIGS. 2, 4 and 5, the outer conductor 12 includes a pair of second side plate portions 73 and a pair of third connection pieces 75. The pair of second side plate portions 73 are connected to a lower part of the rear plate portion 44 and extend forward. The pair of second side plate portions 73 are arranged along lower parts of the outer side surfaces of the pair of first side plate portions 41. The upper ends of the second side plate portions 73 are arranged above the lower surface of the bottom plate portion 42. The lower ends of the second side plate portions 73 are arranged below the lower surface of the bottom plate portion 42 and at the same height position as the lower end of the rear plate portion 44. The front ends of the second side plate portions 73 are arranged forwardly of the rear end of the rear plate portion 42.

The third connection pieces 75 project downwardly from the lower ends of the second side plate portions 73. The third connection pieces 75 are arranged rearwardly of the branched pieces 52 and forwardly of the second connection pieces 70. The third connection pieces 75 are arranged on both left and right sides of the opening 45. In the lateral direction, the third connection pieces 75 are arranged outwardly of both left and right ends of the common base end portion 51 and outwardly of the pair of second connection pieces 70. A width direction of the third connection pieces 75 is the front-rear direction. Widths of the third connection pieces 75 are smaller than those of the branched pieces 52.

Widthwise side surfaces of the third connection pieces 75 are connected to the lower surfaces of the second side plate portions 73 via curved surfaces. Both widthwise end parts and tip parts of the third connection pieces 75 are chamfered. The height positions of the projecting ends of the pair of branched pieces 52, the pair of second connection pieces 70 and the pair of third connection pieces 75 are aligned with each other.

As shown in FIG. 2, each of the pair of second side plate portions 73 described above includes a locking portion 76, and each of the pair of first side plate portions 41 includes a lock receiving portion 77 to be locked to the locking portion 76. The locking portions 76 are formed on the inner side surfaces of the pair of second side plate portions 73 and project inwardly. The locking portion 76 has a locking surface facing rearward. The lock receiving portion 77 is cantilevered downward, and a tip side thereof is resiliently deformed in the lateral direction.

Further, as shown in FIGS. 2 and 6, each of the pair of first side plate portions 41 includes a locking projection 78 and a resilient contact piece 79. The locking projection 78 is a part to be locked to the housing 11 and projects laterally outwardly. The locking projection 78 is locked to a retaining portion (not shown) of the housing 11 to prevent rearward escape. The resilient contact piece 79 is a part to be resiliently held in contact with a mating outer conductor of the mating connector. The resilient contact piece 79 projects laterally inwardly and is resiliently deformed in the lateral direction.

An assembly method of the connector 10 of described below.

The outer conductor 12 is assembled as follows. First, the conductive metal plate is stamped into a developed shape. From this developed shape, the bent portion 50 is formed by bending. Thereafter, the ceiling plate portion 40, the pair of first side plate portions 41 and the bottom plate portion 42 are formed by bending. At this time, the facing end part 62 of the first plate portion 60 and the facing end part 62 of the second plate portion 61 are fit to each other and arranged to face each other.

The inner conductors 14 mounted in the dielectric 13 are inserted from behind into the outer conductor 12 in this state. A forward movement of the dielectric 13 is restricted by the restricting portion 22 butting against the bottom plate portion 42 of the outer conductor 12. Thereafter, the pair of second side plate portions 73 and the rear plate portion 44 are formed by bending. In the process of forming the rear plate portion 44 after the pair of second side plate portions 73 are formed, the locking portions 76 of the pair of second side plate portions 73 resiliently deform the lock receiving portions 77 laterally inwardly. As the bending proceeds and the lock receiving portions 77 return to their original shapes due to resilient forces of their own, the locking portions 76 are locked to the lock receiving portions 77 to restrict rearward movements of the pair of second side plate portions 73. Further, a rearward movement of the dielectric 13 is restricted by the rear plate portion 44.

The outer conductor 12 assembled with the dielectric 13 and the inner conductors 14 is inserted into the housing 11 from behind. A forward movement of the outer conductor 12 is restricted by the common base end portion 51 butting against the rear end of a bottom wall part of the housing 11. Further, the locking projections 78 of the outer conductor 12 are locked to the retaining portions (not shown) of the housing 11 to prevent rearward escape. In this way, the outer conductor 12 is assembled with the housing 11. With the outer conductor 12 assembled with the housing 11, the rear end surface of the outer conductor 12 is arranged forwardly of the rear end surface of the housing 11.

By further mounting the fixing members 15 into the fixing member mounting portions 11A of the housing 11, the connector 10 is completed.

The connector 10 is surface-mounted on the circuit board 90. The circuit board 90 is formed with through holes 90A. The through holes 90A are provided to individually correspond to the respective branched pieces 52, the respective second connection pieces 70, the respective third connection pieces 75, the board connecting portions 32 of the inner conductors 14 and the projection pieces 15A of the fixing members 15. That is, the shape and size of each through hole 90A correspond to those of the part to be inserted thereinto. Solder is applied to the through holes 90A in advance, and the respective parts described above are inserted into these through holes 90A. The connector 10 arranged on the circuit board 90 in this way is soldered to the circuit board 90 by a reflow process. In this way, the board connecting portions 32 of the inner conductors 14 are connected to conductive portions and the respective branched pieces 52, the respective second connection pieces 70 and the respective third connection pieces 75 are connected to a ground portion.

When the mating connector is fit into the connector 10, the mating outer conductor of the mating connector enters the outer conductor 12 and is electrically connected while being pressed inwardly from the resilient contact pieces 79 on both left and right sides.

As described above, since the connector 10 of this embodiment includes the plurality of branched pieces 52, shielding performance can be ensured. Further, the individual holes into which the respective branched pieces 52 are inserted can have a small opening width in the circuit board 90 as a connection partner of the respective branched pieces 52. Further, this connector 10 includes the common base end portion 51 connected to the rear end of the bottom plate portion 42 via the bent portion 50, and the plurality of branched pieces 52 project from the projecting end of this common base end portion 51 while being arranged in the width direction. Thus, in this connector 10, the respective branched pieces 52 can be turned in direction at once in forming the bent portion 50 by bending. Therefore, according to this connector 10, manufacturing is easy and the orientations of the respective branched pieces 52 are easily aligned.

Further, the first facing end parts 63 of this connector 10 are arranged at the positions shifted from the widthwise central part where the bent portion 50 is provided. Thus, the bent portion 50 provided in the widthwise central part is not divided in the width direction. Further, the second facing end parts 64 of this connector are arranged at positions closer to a widthwise center than the first facing end parts 63. Thus, the first and second plate portions 60, 61 are easily formed by bending.

Further, since the width of the bent portion 50 is smaller than that of the common base end portion 51 according to this connector 10, the bent portion 50 is easily bent and a bending angle of the bent portion 50 is easily adjusted.

Other Embodiments of Present Disclosure

The embodiment disclosed this time should be considered illustrative in all aspects, rather than restrictive.

(1) Although two branched pieces are shown as an example in the above embodiment, three or more branched pieces may be provided.

(2) Although the facing end part includes the first and second facing end parts shifted in the width direction in the above embodiment, the first and second facing end parts may be not shifted in the width direction.

(3) Although the first plate portion is provided with one fitting portion and the second plate portion is provided with two fitting portions in the above embodiment, the numbers of the fitting portions can be arbitrarily set.

(4) Although the width of the bent portion is smaller than that of the common base end portion in the above embodiment, the width of the bent portion may be equal to or larger than that of the common base end portion.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A connector, comprising an outer conductor and an inner conductor, wherein:

the outer conductor includes four plate portions for surrounding an outer peripheral surface of the inner conductor, a rear plate portion for closing a rear surface of the outer conductor, and an opening provided behind one plate portion, out of the four plate portions, and in front of the rear plate portion, the inner conductor includes a board connecting portion projecting outwardly of the outer conductor through the opening, the outer conductor includes:

a common base end portion connected to a rear end of the one plate portion via a bent portion and projecting toward the same side as the board connecting portion; and a plurality of branched pieces projecting from a projecting end of the common base end portion while being arranged in a width direction of the common base end portion, and wherein the one plate portion includes a first plate portion arranged on one side in the width direction and a second plate portion arranged on the other side in the width direction, the respective first and second plate portions include facing end parts arranged to face each other, the facing end part includes a first facing end part extending forward from a rear end of the one plate portion, a second facing end part extending rearward from a front end of the one plate portion and a third facing end part linking a front end of the first facing end part and a rear end of the second facing end part, and the second facing end part includes fitting portions and fitting grooves to be fit to each other.

2. The connector of claim 1, wherein:

the first facing end part is arranged at a position shifted from a central part in the width direction where the bent portion is provided in the one plate portion, and the second facing end part is arranged at a position closer to a center in the width direction than the first facing end part in the one plate portion.

3. The connector of claim 2, wherein the third facing end part extends in a width direction of the one plate portion.

4. The connector of claim 1, wherein the plurality of branched pieces have continuous surfaces continuous from both widthwise side surfaces of the common base end portion without a step.

5. The connector of claim 1, wherein the outer conductor further includes:

a pair of additional plate portions that are connected to a lower part of the rear plate portion, extend forward, and include connection pieces projecting downwardly from lower ends of the additional plate portions.

6. The connector of claim 1, wherein a width of the bent portion is smaller than that of the common base end portion.

7. The connector of claim 1, wherein a first fitting portion of the first plate portion projects toward the second plate portion, second fitting portions of the second plate portion project toward the first plate portion, the second fitting portions of the second plate portion are fit into first fitting grooves of the first plate portion, and the first fitting portion of the first plate portion is fit into a second fitting groove of the second plate portion.

* * * * *